United States Patent [19]

Hendriks

[11] 4,311,436

[45] Jan. 19, 1982

[54] FLUID PRESSURE AND VELOCITY SENSING APPARATUS

[75] Inventor: Ferdinand Hendriks, Yorktown Height, N.Y.

[73] Assignee: International Business Machines Corporation, Armonk, N.Y.

[21] Appl. No.: 94,401

[22] Filed: Nov. 13, 1979

[51] Int. Cl.[3] ..... F04B 41/06

[52] U.S. Cl. ..... 417/2; 73/196; 417/43; 417/45; 417/63

[58] Field of Search ..... 417/14, 24, 42–45, 417/63, 2–6, 216; 73/196, 195, 861.42; 137/100

[56] References Cited

U.S. PATENT DOCUMENTS

| | | | |
|---|---|---|---|
| 1,920,752 | 8/1933 | Kissing et al. | 415/17 |
| 2,352,312 | 6/1944 | Donaldson | 73/196 X |
| 3,425,278 | 2/1969 | Buzza | 73/196 X |
| 3,771,348 | 11/1973 | Villarroel | 73/196 X |
| 4,097,872 | 6/1978 | Giordano et al. | 239/299 X |
| 4,175,433 | 11/1979 | Rikuta | 73/196 |

*Primary Examiner*—Carlton R. Croyle
*Assistant Examiner*—Edward Look
*Attorney, Agent, or Firm*—Jack M. Arnold

[57] ABSTRACT

Apparatus for measuring fluid pressure and velocity, and in particular for maintaining an aspirator air velocity constant under varying atmospheric conditions. A precisely controlled air velocity is provided by a reference air source whose frequency is derived from a crystal oscillator. The total air pressure from the aspirator wind tunnel is compared with the total air pressure from the reference air source using a matched thermistor pair technique to convert the pressure difference into an electrical error signal which is used to control the main air source for the aspirator wind tunnel such that the error signal is maintained at zero, thereby maintaining the air velocity in the aspirator constant.

11 Claims, 3 Drawing Figures

FLUID PRESSURE AND VELOCITY SENSING APPARATUS

TECHNICAL FIELD

The invention is in the field of measuring fluid pressures and velocities, including both gases and liquids. In general, the invention is directed to fluid servo systems, and especially gas servo systems for ink jet aspirators. In particular, an aspirator air servo system for an ink jet printer is disclosed in which the aspirator air speed is maintained substantially constant under varying atmospheric conditions.

In an ink jet printing system, one of the primary causes of the misregistration of droplets on a printing medium is the interaction of droplets in flight. There are two causes for the droplet interaction, namely the charge on the droplets and the aerodynamic drag on the respective droplets. The charge interaction and the aerodynamic interaction are generally never observed independently, and in most instances are closely related. Charge interaction would be less severe without the presence of aerodynamic drag. That is, the presence of aerodynamic drag magnifies the effect of charge interactions. In the absence of aerodynamic drag, the only distortions are of electrostatic origin, and thus one could consider whether it would be beneficial to print with a lower drop charge and a longer throw length to obtain the identical deflection for the two cases. The repulsion of two equally charged drops, except for the very beginning of the interaction, is proportional to the drop charge times the throw length. For a given deflection voltage, one-fourth of the original charge is needed when the length over which the electric deflection field exists is doubled. Thus, the charge repulsion is halved, since it is proportional to the product of charge and deflection length.

Without some form of aspiration to compensate for aerodynamic drag, the benefits of an increased throw length are inaccessible due to aerodynamic distortions, e.g., drop merging, which would occur long before the double throw length is traversed.

The use of an aspirator relaxes the necessity to deflect droplets in a very short distance and substantially decouples the motion of droplets relative to each other. Accordingly, this makes the drop deflection a more linear function of the drop charge.

Fundamental to proper operation of ink jet aspiration is the maintenance of airspeed in the channel surrounding the ink droplets. This speed must be kept constant under variations in environmental changes of pressure, temperature, humidity, density, etc. Furthermore, the airspeed must remain insensitive to the gradual change of air resistance of air filters. Airspeed regulation for aspirated ink jets involves airspeeds on the order of 10 to 20 m/sec. At these speeds, methods that rely on pressure detection using deflection of thin membranes suffer from lack of sensitivity or temperature drift or both, unless considerable amplification and compensation are applied. Thermal sensors, although very sensitive, are still subject to calibration drift due to aging and contamination unless correlation techniques are used, requiring more than one sensing element in the flow to be measured. It is desirable for the present application to have a technique that poses no increased load on the air pump and that introduces no disturbances into the flow to be controlled. From the latter points of view, flow sensors based on the principle of vortex shedding are troublesome in the presently considered speed range; however they are also quite rugged and inexpensive.

According to the present invention, an airspeed measuring system and air servo system is set forth utilizing a technique which is minimally intrusive, and is within the bounds of drift of modern analog electronic circuitry, and insensitive to environmental changes. The air servo system utilizes a fluid flow measuring device having an output which is linearly related to the air velocity down to zero velocity.

BACKGROUND ART

There are several techniques known for reducing the charge interaction between adjacent droplets in an ink jet printing system. U.S. Pat. No. 3,562,757 of Bischoff, describes an ink jet system wherein charge interaction between adjacent droplets and aerodynamic drag is compensated for. The compensation comprises utilizing the "guard drop" principle in which every other droplet is charged, such that every other droplet is guttered thereby effecting an increase in distance between the droplets which are used for printing, thereby reducing the charge interactions between printing droplets as well as the wake between the droplets used for printing. In Bischoff there is no aspiration used, and the efficiency of the system is decreased due to the guttering of an excessive number of droplets.

The concept of utilizing a gas stream, such as air, to compensate for aerodynamic drag in an analog deflected ink jet system is set forth in U.S. Pat. No. 3,596,275 of Sweet. Sweet introduces a colinear stream of air, used to reduce the effects of the wake of a given droplet relative to a following droplet, with the objective being to remove the drag on each droplet. However, in Sweet, the gas stream becomes turbulent before it matches the drop velocity. In Sweet, the ink jet nozzle is mounted on an airfoil-like structure which is placed near the center of a wind tunnel where the air stream is accelerated to near maximum velocity. Since even a good airfoil has a small but unstable wake which is swept along with the ink droplets the droplets trajectory of Sweet is affected by the wake and accordingly optimum minimization of aerodynamic distortion is not achieved.

U.S. Pat. No. 3,972,051 of Lundquist et al discloses an ink jet printing system which includes a laminar airflow passageway through which ink droplets are directed before striking a moving print medium. The airflow is created by suction at the downstream end of the passageway, with the airflow not being filtered before it enters the passageway. Accordingly, aerodynamic disturbance of the airflow might be created by the air passing over the charge electrode and deflection electrodes. The geometry of the entrance and exit apertures of the passageway is rectangular, with the passageway having a non-uniform cross-sectional area, with the laminar flow of the air having a non-constant velocity and being reduced in velocity as the airflow approaches the print medium. Here too, the air velocity is everywhere only a fraction of the droplet velocity to avoid turbulence.

U.S. Pat. No. 4,097,872 to Giordano et al., which is assigned to the assignee of the present invention, discloses an aspirator for an ink jet printing system in which the aspirator includes a passageway, such as a tunnel, having a constant cross-sectional area, and in which the velocity of the airflow therethrough is substantially constant and equal to the ink droplet velocity such that the aerodynamic drag on the droplets is substantially eliminated.

Although the art above discloses air aspiration systems, none of this art sets forth any air servo systems for an ink jet aspirator for maintaining a constant air velocity input to the aspirator. Systems for the control of airflow, are however, generally known. One such system, is set forth in U.S. Pat. No. 3,425,278 to Buzza, which discloses a flow meter which controls the flow of air through a first pipe to match the flow of air through a second pipe, with the control flow of air through the first pipe being indicative of the rate of flow through the second pipe. U.S. Pat. No. 1,920,752 to Kissing et al discloses a fluid pressure regulator for prime movers and the like, whereby actuations of the regulator due to changes in viscosity or like physical characteristics of the actuating fluid are compensated for.

None of the above cited art discloses a fluid velocity measuring system as described herein, or suggests the use of an air servo system for controlling the velocity of airflow in an enclosure such as an ink jet aspirator to a constant velocity by sensing either the velocity or pressure therein and comparing it with a reference velocity or pressure, respectively. According to the present invention, such an aspirator air servo system is set forth, wherein a precisely controlled air velocity and pressure are provided by a reference air source whose frequency is derived from a crystal oscillator. The total air pressure from the aspirator wind tunnel is compared with the total air pressure from the reference air source using a matched thermistor pair technique to convert the pressure difference into an electrical error signal which is used to control the main air source for the aspirator wind tunnel such that the error signal is maintained at zero thereby maintaining the air velocity in the aspirator constant.

DISCLOSURE OF THE INVENTION

Figure 1:
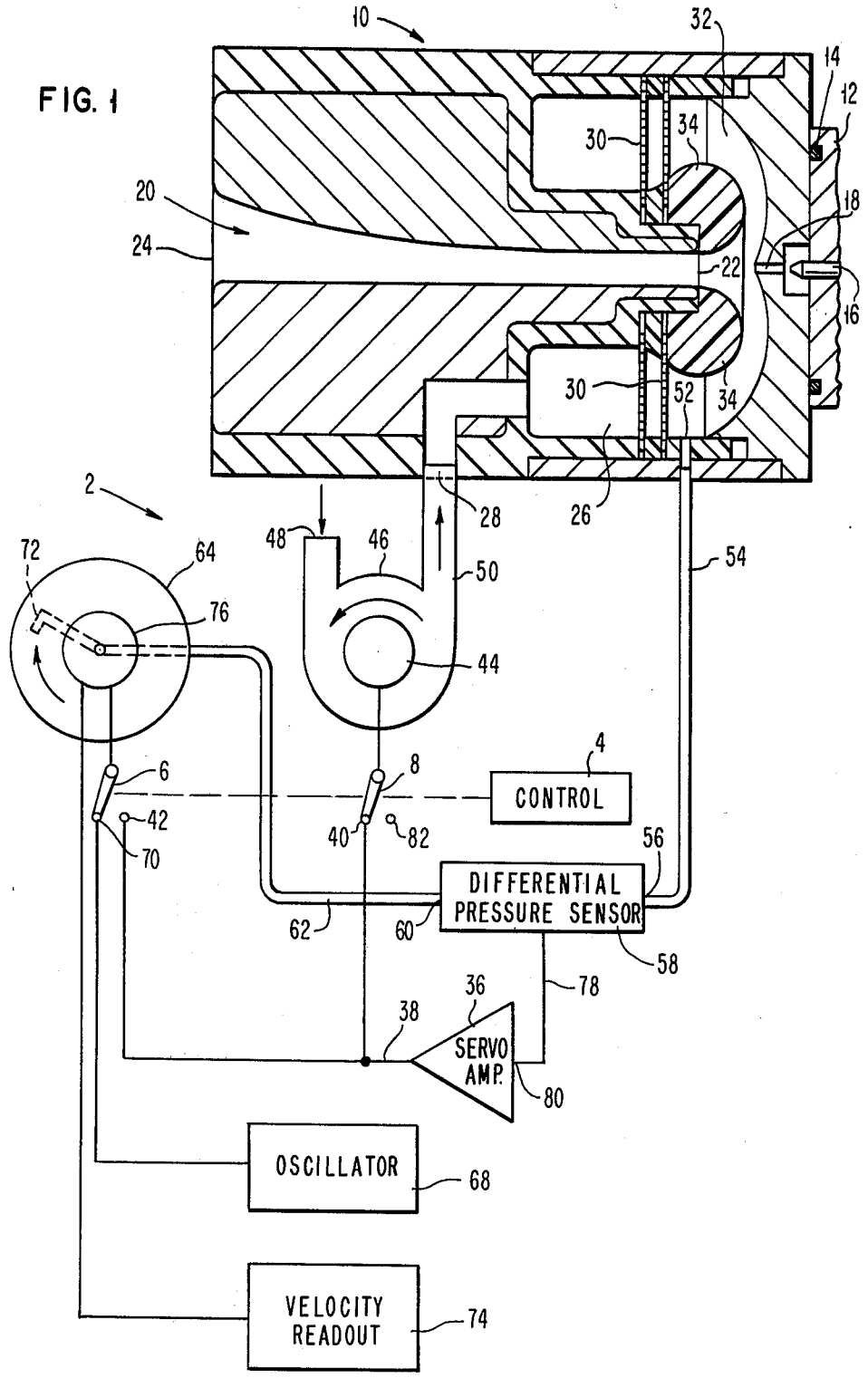
FIG. 1 is a block diagram representation of a fluid velocity measuring system and an air servo system for an ink jet printing system according to the present invention.

Apparatus is disclosed for measuring fluid velocity and maintaining an aspirator airspeed constant under varying atmospheric conditions. A precisely controlled air pressure is provided by a reference air source. The total air pressure from the aspirator wind tunnel is compared with the total air pressure from the air source to provide a pressure difference which is used to generate an error signal for controlling the main air source for the aspirator wind tunnel such that the error signal is maintained substantially at zero, thereby maintaining the air velocity in the aspirator constant.

BEST MODE FOR CARRYING OUT THE INVENTION

To maintain an ink jet aspirator air speed constant under varying atmospheric conditions, closed loop control of the aspirator air source is required. Many sensors however, for example hot film, are themselves susceptible to atmospheric changes. The system set forth below is not susceptible to such atmospheric changes.

A crucial element in an aspirated ink jet system is the combination of sensor, servo amplifier, and aspirator air source which ensures that the velocity, not the mass flow, in the aspirator tunnel is maintained substantially constant even under varying atmospheric conditions and various types of contamination. According to the present invention, the principle is to generate a precisely controlled air velocity utilizing a reference air source whose frequency is derived from the ink jet printer's crystal oscillator. The total air pressure from the aspirator wind tunnel is compared with the total air pressure from the reference air source utilizing a matched thermistor pair technique to convert the pressure difference into an electrical error signal to control the main air source such that the error signal is maintained substantially at zero.

The fundamental idea in the fluid servo system of the present invention is to compare the fluid flow velocity to be measured with a fluid velocity created by a reference fluid source and to utilize the result of the comparison to drive the aspirator fluid source.The reference source, in this instance an air source, is preferably a pitot pump in which the air assumes the speed of a rotating drum filled with internal radial vanes. The pressure pick-up device, for example a tube or "scoop", is of minimal size such that it creates minimal disturbance to the flow internal to the pitot pump. A capillary tube senses a velocity equal to $\rho v_p^2$, where $v_p$ is the circumferential speed of the pump drum at the location of the pressure pick-up capillary, and $\rho$ is the air density. Using a constant speed pitot pump, for instance by using a crystal controlled oscillator to control a synchronous motor, the speed $v_p$ is held fixed within close tolerances. The density $\rho$ is allowed to take on ambient values. In the aspirator, the pressure just downstream of the smoothing source is equal to $\frac{1}{2}\rho v_a^2$, where $v_a$ is the aspirator air speed which is equal to the speed of the ink droplets passing through the aspirator. Again, $\rho$ is the air density and takes on ambient values, and $v_a$ is the parameter to be regulated. Under zero error conditions the system equation is:

$$\rho v_p^2 = \tfrac{1}{2}\rho v_a^2$$

which shows the device is insensitive to the air density $\rho$. In the practice of the invention, the preferred way to sense pressure errors is to utilize a pair of matched thermistors mounted in a narrow capillary. Other differential pressure sensors, such as those based on ionization and piezo-resistive diaphragms, may also be used in the practice of the invention. When utilizing thermistors, they are operated in the self-heated mode; with the thermistor pair being capable of detecting pressure imbalances on the order of 1 $N/m^2$ or approximately $10^{-5}$ atmospheres, where N is Newtons and m is meter. It follows that at an aspirator tunnel speed of 10 m/sec., the pressure comparator device is capable of detecting tunnel airspeed changes on the order of 1%. Utilizing the matched thermistor pair for sensing pressure imbalances is most advantageously used in an electronic bridge circuit configuration, with the sensed pressure differential being converted to a voltage error signal for controlling the aspirator air pump.

The thermistors are typically mounted in the lower two legs of a Wheatstone bridge. Alternatively, each thermistor may be operated in the constant temperature mode. In the latter case, each thermistor operates with its own servo amplifier which maintains the resistance of the respective thermistors at a constant value. Servo feedback techniques utilizing an integrating element are preferred to ensure zero steady state error. To achieve sufficient damping and stable operation of the system, it is generally necessary to utilize a restrictor in the line connecting the reference air source with the aspirator. The frequency response of the control system is heavily dependent on the mechanical time constant of the aspirator air pump/motor combination. Variations of the aspirator servo system may be measured by connecting a tachometer to the reference air pump.

FIG. 1 illustrates a fluid velocity and pressure measuring system, which is switchable between an air servo system for controlling an aspirator for an ink jet printer or the like in a first switch position, and as a velocity measuring device for sensing the velocity of an unknown source of a fluid such as air, when in the second switch position. The system is illustrated generally at 2, with a control device 4 operating switch arms 6 and 8 to switch between the two modes of operation. The arms 6 and 8 are illustrated in the first position such that the system operates as an air servo control system for an ink jet aspirator. When the switch is in the second position, the system operates as a velocity readout system for determining the air velocity of an unknown air source. An aspirator 10, which is set forth in detail in the referenced U.S. Pat. No. 4,097,872, has an ink jet head 12 attached thereto in an airtight manner by O ring seal 14. An ink jet nozzle 16 is mounted in the head 12, with the nozzle 16 being in axial alignment with a passageway 18 which is in axial alignment with a constant cross-sectional area tunnel 20 in the aspirator 10. In practice, the entrance aperture 22 of the tunnel 20 is circular in cross-section and changes in geometry along its axis to a non-circular geometry at its exit aperture 24. Preferably, the tunnel's exit geometry is elliptical or rectangular. The geometry of the tunnel is constant in cross-sectional area from one plane to the next, when measured transverse to the longitudinal axis of the tunnel. An air settling chamber 26 is included in the aspirator 10, with an input 28 receiving a gas such as air from an outside source, with the air passing through an air turbulence decreasing means 30 which may be comprised of screens or the like. The air then passes through a curvilinear passageway 32 and over curvilinear surfaces 34 into the mouth of the tunnel 20. How the air velocity is maintained constant in the tunnel under varying atmospheric conditions is set forth below.

A control device such as a signal conditioner and servo amplifier 36 provides an error signal on an output line 38 to teminals 40 and 42. The control signal applied to terminal 40 is passed via the switch arm 8 to a variable speed motor 44. The motor 44 drives a main air source 46 to pull in air at an air inlet 48 and provide air flow through an output conduit 50 to the input 28 of the aspirator 10. The air entering the settling chamber 26 passes through the air turbulence decreasing means 30 and flows through the curvilinear passageway 32 to the entrance of the tunnel 20 and out the exit aperture 24. A pressure sensing port 52 in the aspirator 10 is situated such that the air flow through the aspirator is sensed and passed via a capillary tube 54 to a first input 56 of a differential pressure sensor 58 for comparison with a reference air pressure provided to a second input 60 via a capillary tube 62.

A reference air source 64 is comprised of a pitot pump which discharges into atmospheric conditions, i.e., it has no load. Accordingly, the unloaded drum of the pump operates in a manner such that the air flowing through the pump moves at the same speed as the drum, as does the air at the exit of the pump. The pump 64 is controlled by a crystal oscillator 68, when the switch arm 6 is in contact with the terminal 70 as shown in the drawing. In practice, the oscillator 68 is the main oscillator and timing mechanism for the ink jet printer. The synchronized periodic output signal from the oscillator 68 controls the speed of the pump 64, and accordingly the air flow therethrough. A total pressure probe 72, is connected to the air passageway in pump 64, with the pressure sensed by the probe being provided via the capillary 62 to the differential pressure sensor 58. A velocity readout device, such as a tachometer 74, is connected to the motor 76 of the pump 64 for providing a readout of the velocity of the motor, and accordingly the velocity of the air flow through the unloaded pump.

As previously stated, the preferable way of sensing the differential pressure between the reference air source and the pressure in the aspirator is through the use of a pair of matched thermistors mounted in a narrow capillary. The thermistors are operated in the self-heated mode, that is any change in pressure across the thermistors provides a change in temperature thereof, unless the thermistors are operated at a constant temperature, in which case an unbalance in thermistor current results. Accordingly, when the thermistors are connected in a signal conditioning and servo amplifier device, which may include a Wheatstone bridge, any difference in the cooling rate of the thermistors causes an unbalance in the bridge and accordingly an error signal is produced. An error signal is provided on an output line 78 from the differential pressure sensor 58 to the input 80 of the signal conditioner and servo amplifier 36, with the signal output from the amplifier 36 being provided, as previously set forth, from output line 38 via switch arm 40 to the motor 44 of the aspirator air pump 46. This results in a change in speed of operation of the pump 45, and accordingly the air flow to the aspirator 10 changes such that the differential pressure sensed by device 58 is essentially reduced to zero to maintain the velocity of the air flow into the aspirator substantially constant. When the control device 4 switches to the second mode of operation, switch arm 6 is moved into contact with terminal 42, and switch arm 8 is moved into contact with terminal 82. It is seen, therefore, that the motor 44 of the pump 46 is then no longer controlled by servo amplifier 36 and accordingly runs in a free mode of operation, and motor 76 of pump 64 is now controlled by the output of servo amplifier 36. Accordingly, the velocity of the air flow through capillary 54 from pump 46 is unknown. The air pressure from the pump 46 is compared, as before, with the air pressure from the pump 64. When the speed of the pump 64 becomes substantially equal to the speed of the pump 46, as controlled by the output of servo amplifier 36, the velocity readout by the tachometer 74 is then an indication of the velocity of the air from an unknown air source, that is, the air velocity from the pump 46. In the second mode of operation, the system operates as a velocity air flow sensor for an unknown air source. A simplified version of this type of system operation is set forth in FIG. 3.

Figure 2:
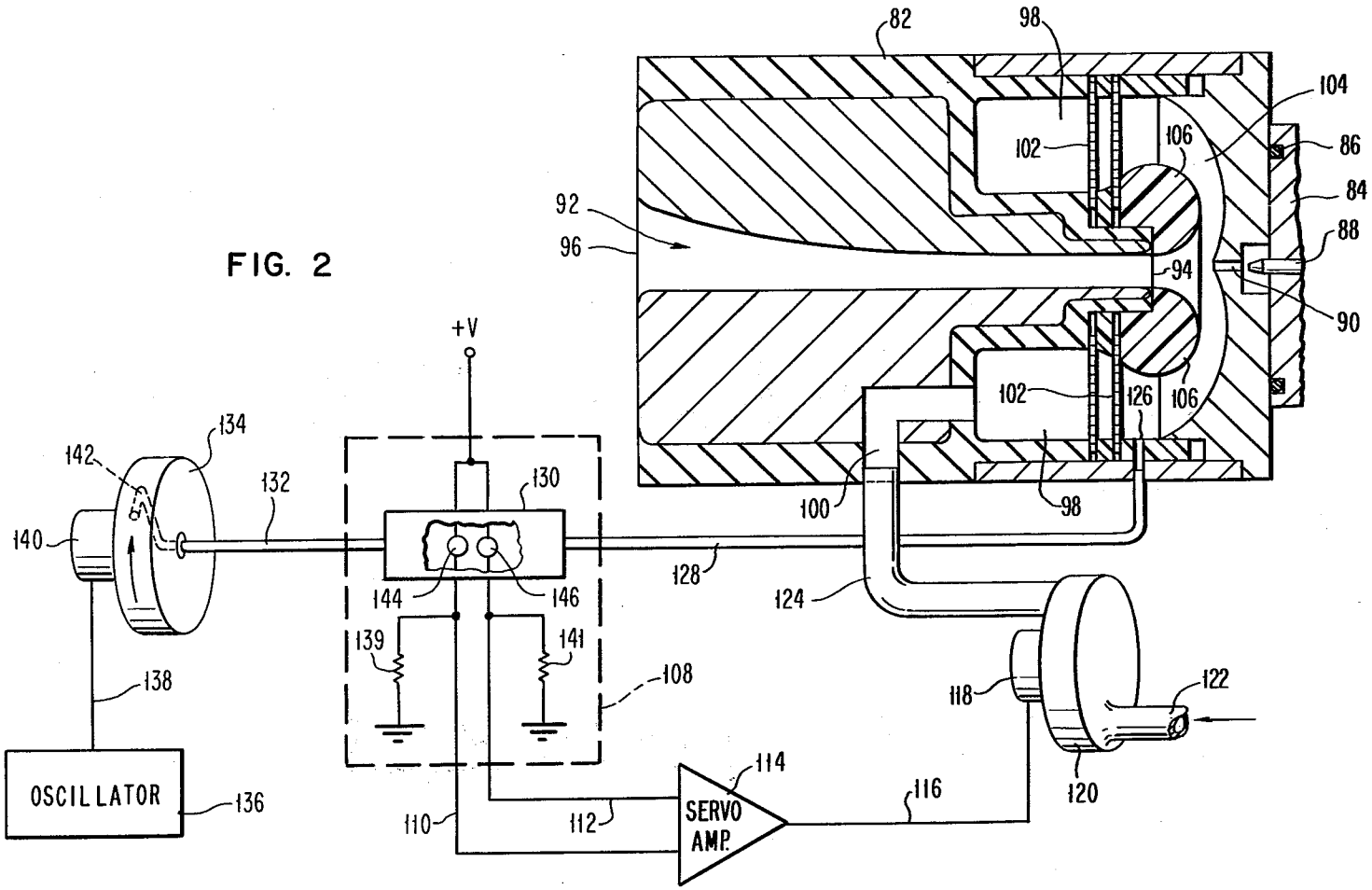
FIG. 2 is a block diagram representation of an air servo system for an ink jet printing system according to the present invention.

Refer now to FIG. 2 which illustrates the air servo system according to the present invention. An aspirator 82, which is set forth in detail in the referenced U.S. Pat. No. 4,097,872, has an ink jet head 84 attached thereto in an airtight manner by O ring seal 86. An ink jet nozzle 88 is mounted in the head 84, with the nozzle 88 being in axial alignment with a passageway 90 which is an axial alignment with a constant cross-sectional area tunnel 92 in the aspirator 82. In practice, the entrance aperture 94 of the tunnel 92 is circular in cross-section and changes in geometry along its axis to a non-circular geometry at its exit aperture 96. Preferably the tunnel's exit geometry is elliptical or rectangular. The geometry of the tunnel is constant in cross-sectional area from one plane to the next, when measured transverse to the longitudinal axis of the tunnel. An air settling chamber 98 is included in the aspirator 82, with an input 100 receiving air from an outside source, with the air passing through an air turbulence decreasing means 102 which may be comprised of screens or the like. The air then passes through a curvilinear passageway 104 and over curvilinear surfaces 106 into the mouth of the tunnel 92. How the air velocity is maintained constant in the tunnel under varying atmospheric conditions is set forth below.

A control device such as a Wheatstone bridge 108 provides an error signal on output lines 110 and 112 to a servo amplifier 114 for providing a control signal on an output line 116 to a variable speed motor 118. The motor 118 drives a main air source 120 to pull in air at an input 122 and provide air flow through an output conduit 124 to the input 100 of the aspirator 82. The air entering the settling chamber 98 passes through the air turbulence decreasing means 102 and flows through the curvilinear passageway 104 to the entrance 94 of the tunnel 92 and out the exit aperture 96. A pressure sensing means 126 consisting of a static pressure tap is situated just downstream from the smoothing means 102 at a position where the static pressure is equal to the tunnel dynamic pressure. The pressure sensed is passed through a capillary tube 128 to a chamber 130, for comparison with a reference air pressure provided via a capillary 132.

A reference air source 134 is comprised of a pitot pump operated under zero discharge conditions. The pitot pump operates in a manner such that the air moves at the same speed as a rotating drum filled with internal radial vanes. The pitot pump speed is controlled by a crystal oscillator 136, which in practice is the main oscillator and timing mechanism for the ink jet printer. The synchronized periodic output signal from the oscillator 136 is provided on an output line 138 to a synchronous motor 140 for controlling the operation thereof for driving the reference air source 134. A stationary total pressure probe 142 is connected in the air passageway of pump 134, with the pressure sensed being provided by the capillary 132 to the chamber 130.

A matched thermistor pair, comprised of thermistors 144 and 146 are responsive to small air flows caused by the pressures in the capillaries 128 and 132 respectively. The thermistors 144 and 146 form part of the Wheatstone bridge 108. The thermistors are connected in common at one end thereof to a source of voltage +V. The other end of thermistor 144 is connected to circuit ground via a resistor 139, and to a first input of servo amplifier 114 via the line 110. The other end of thermistor 146 is connected to ground via a resistor 141, and to a second input of servo amplifier 114 via the line 112. The resistors 139 and 141 are chosen to be of the same ohmic value. The thermistors are operated in a self-heated mode, with the difference in resistance caused by any variations in pressure sensed being sensed by the Wheatstone bridge 108. As is known, any unbalance of the bridge 108 provides a resultant error signal on the lines 110 and 112, with the servo amplifier 114 thereby controlling the variable speed motor 118 to maintain the air pressure supplied to the tunnel 92 substantially equal to the air pressure supplied from the pump 134. Accordingly, the air velocity in the tunnel 92 is maintained substantially constant.

Figure 3:
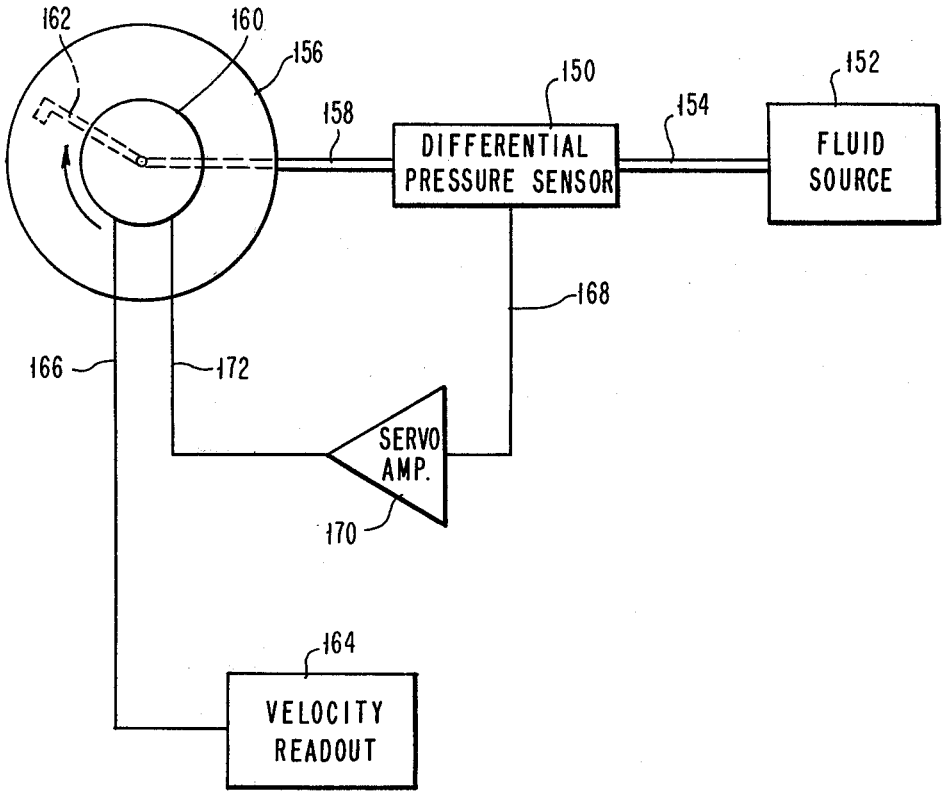
FIG. 3 is a block diagram representation of a fluid velocity measuring system according to the present invention.

FIG. 3 illustrates a fluid velocity measuring system similar to that set forth in FIG. 1 when the control mechanism causes the system to switch to the second mode of operation. A differential pressure sensing mechanism 150 compares the fluid pressure from an unknown source of fluid 152 via a capillary 54 with a flow of fluid from a control source 156 via a capillary 158. The control source 156 is a pitot pump, which is driven by a variable speed motor 160, with a capillary pick-up 162 measuring the pressure caused by the solid-body rotation of the air within the pump which is supplied to the capillary 158. A tachometer device 164 is connected via lead 166 to the motor 160 of the pump 156 for measuring the speed of rotation of the pump, and accordingly the velocity of air flow therethrough since the air moves in unison with the pitot pump housing. A signal indicative of the differential pressure sensed by the sensor 150 is provided via line 168 to a servo amplifier 170, with the servo amplifier providing an error signal on an output line 172 to the motor 160 to control the speed of operation thereof such that the differential pressure sensed by the device 150 is driven to zero. Accordingly, in this condition the speed of operation of the pump 156 is substantially equal to the velocity of the fluid from the source 152, and the velocity readout is provided on the tachometer device 164 indicating the fluid flow velocity from the source 152. The source 152 may be ambient air.

INDUSTRIAL APPLICABILITY

It is an object of the invention to provide an improved fluid pressure and velocity measuring apparatus.

It is another object of the invention to provide an improved fluid servo system.

It is yet another object of the invention to provide an improved air servo system.

It is still another object of the invention to provide an improved air servo system which maintains a constant air velocity through an enclosure independent of varying atmospheric conditions.

It is a further object of the invention to provide an improved aspirator air servo system for an ink jet printing system, wherein the airflow through the aspirator is maintained substantially constant independent of varying atmospheric conditions.

It is still a further object of the invention to provide an improved aspirator air servo for an ink jet printing system utilizing a precisely controlled air velocity utilizing a reference air source whose frequency is derived from the ink jet printer's crystal oscillator.

It is yet a further object of the invention to provide an improved aspirator air servo for an ink jet printing system utilizing a matched thermistor pair technique to convert a sensed pressure difference between the pressure in the aspirator and a reference pressure source into an error signal to control the main air source for the aspirator.

Having thus described my invention, what I claim as new, and desire to secure by Letters Patent is:

1. In apparatus for measuring the velocity of a first fluid, the combination comprising:

means for supplying said first fluid at a velocity and pressure to be determined;

differential pressure sensing means, having a first input for sensing the pressure of said first fluid and a second input for sensing the pressure of a second fluid, for providing a sensed pressure differential between said first and second fluids, with said pressure differential approaching zero as said pressure of said first and second fluids approach being equal;

transducer means responsive to said sensed differential pressure by said differential pressure sensing means for providing an electrical control signal which is indicative of the sensed differential pressure;

an electrically controlled reference pressure source which provides said second fluid to said second input of said differential pressure sensing means at a controlled pressure and velocity, with the velocity and pressure of said second fluid from said reference pressure source being controlled as a function of said electrical control signal; and means for measuring the velocity of operation of said reference pressure source, with the measured velocity being indicative of the velocity of said first fluid.

2. In an air servo system, the combination comprising:

an enclosure to which air is provided;

an electrically controlled air source connected to said enclosure for providing air to said enclosure;

a reference air source;

means connected to said enclosure and said reference air source for sensing the difference in pressure in said enclosure and in said reference air source for deriving a pressure difference signal; and transducer means responsive to the derived pressure difference signal for providing an electrical error signal to said electrically controlled air source to control the airflow therefrom to said enclosure.

3. In an air servo system, the combination comprising:

an air passageway to which air is provided;

an electrically controlled air source responsive to an electrical error signal for providing a controlled airflow to said air passageway at an unknown pressure;

a reference air source for providing air at a reference pressure;

an airflow sensing means connected to sense the pressure differential between the airflow in said reference air source, and the airflow through said air passageway, for producing a pressure differential; and transducer means responsive to the pressure differential produced in said airflow sensing means for producing said electrical error signal which is indicative of the pressure differential pressure, with said electrical error signal being provided to said electrically controlled air source to control same for providing said controlled airflow therefrom to said air passage way.

4. In an air servo system for an ink jet aspirator, the combination comprising:

an air tunnel in said aspirator, having an input and an output;

an electrically controlled air source responsive to an electrical error signal for providing air to the input of the air tunnel of said aspirator at a controlled velocity determined by said electrical error signal, for providing airflow to the output thereof;

a reference air source for providing a reference airflow;

an airflow sensing means for sensing the pressure differential between the airflow from said reference air source and the airflow through said air tunnel in said aspirator, for producing a pressure differential; and transducer means responsive to the produced pressure differential in said airflow sensing means, and for converting same to said electrical error signal for provision to said electrically controlled air source to control same for providing air therefrom to the air tunnel in said aspirator.

5. In an air servo system for an ink jet aspirator, the combination comprising:

an air tunnel in said aspirator, having an air input and an air output;

a controlled air source for providing air to the input of said air tunnel of said aspirator;

a variable speed motor connected to said controlled air source for causing said controlled air source to provide air to said input of said aspirator at a velocity determined by the speed of operation of said variable speed motor;

a servo amplifier having an input, and an output which provides a control signal to said variable speed motor for controlling the speed of operation thereof;

a reference air source for providing a reference flow of air;

a synchronous motor for controlling the airflow of said reference air source;

an oscillator for providing timing signals to control the speed of operation of said synchronous motor;

first and second pressure probes, connected to sense the air pressure in said reference air source and said air tunnel of said aspirator, respectively; and pressure responsive means for sensing the difference in air pressure between the air pressure sensed by said first and second pressure probes for providing an error signal to the input of said servo amplifier for controlling same to provide said control signal is provided to said synchronous motor.

6. The combination claimed in claim 5, wherein said pressure responsive means includes a matched thermistor pair, being responsive to the pressure difference between said first pressure probe, and the second pressure probe.

7. The combination claimed in claim 6, wherein said matched thermistor pair are included in a Wheatstone bridge which provides said error signal.

8. In apparatus for measuring the velocity of a first fluid, the combination comprising:

means for supplying said first fluid at a velocity to be determined;

differential pressure sensing means comprised of a matched thermistor pair, with the first thermistor being responsive to the pressure of said first fluid, and said second thermistor being responsive to the pressure of a second fluid, with the differential pressure sensed by said matched thermistor pair being converted to a control signal which is indicative of the sensed differential pressure;

a reference pressure source comprised of a pump which provides said second fluid to the second thermistor in said differential pressure sensing means at a controlled velocity, with the velocity of said second fluid from said reference pressure source being controlled by said control signal provided from said differential pressure sensing means.

9. In an air servo system, the combination comprising:

an air passageway to which air is provided;

a controlled air source responsive to a provided error signal for providing a controlled airflow to said air passageway at an unknown pressure;

a reference air source for providing air at a reference pressure; and an airflow sensing means connected to sense the pressure differential between said reference air source and the airflow in said air passageway for producing a pressure differential, wherein said airflow sensing means includes a matched thermistor pair, with the first thermistor being responsive to the pressure from said reference air source, and the second thermistor being responsive to the pressure in said air passageway, with the sensed pressure differential being used to control the airflow from said controlled air source to said air passageway.

10. In an air servo system for an ink jet aspirator, the combination comprising:

an air tunnel in said aspirator, having an input and an output;

a controlled air source responsive to a provided error signal for providing air to the input of said air tunnel of said aspirator for providing airflow to the output thereof;

a reference air source for providing a reference airflow; and an airflow sensing means for sensing the pressure differential between the airflow from said reference air source and the airflow through said air tunnel in said aspirator, with said airflow sensing means including a matched thermistor pair which is responsive to the air pressure from said reference air source and the airflow through said tunnel, for providing a pressure differential which is converted to said error signal for provision to said controlled air source to control the velocity of the air therefrom to said air tunnel of said aspirator.

11. In an air servo system for an ink jet aspirator, the combination comprising:

an air tunnel in said aspirator having an air input and an air output;

a controlled air source responsive to a provided electrical error signal for providing air at a controlled velocity to the air input of said air tunnel of said aspirator for providing airflow to the output thereof;

a reference air source for providing a reference airflow; and air pressure differential sensing means for sensing the air pressure differential between the airflow from said reference air source and the airflow from said controlled air source to said air tunnel of said aspirator, including means for converting the sensed air pressure differential to said electrical error signal for provision to said controlled air source for controlling the velocity of the airflow provided therefrom to the air tunnel in said aspirator.

* * * * *